US007104083B2

(12) United States Patent
Dubé

(10) Patent No.: US 7,104,083 B2
(45) Date of Patent: Sep. 12, 2006

(54) REFRIGERATION SYSTEM CONFIGURATION FOR AIR DEFROST AND METHOD

(76) Inventor: Serge Dubé, 2595 Du Bourgogne, St. Lazare, Quebec (CA) J7T 2C1

( * ) Notice: Subject to any disclaimer, the term of this patent is extended or adjusted under 35 U.S.C. 154(b) by 127 days.

(21) Appl. No.: 10/778,142

(22) Filed: Feb. 17, 2004

(65) Prior Publication Data

US 2005/0028544 A1 Feb. 10, 2005

Related U.S. Application Data

(63) Continuation-in-part of application No. 10/632,921, filed on Aug. 4, 2003, now abandoned.

(51) Int. Cl.
*F25B 7/00* (2006.01)
*F25B 39/09* (2006.01)
*F25D 21/00* (2006.01)

(52) U.S. Cl. ..... 62/272; 62/525

(58) Field of Classification Search ..... 62/272, 62/271, 525, 80, 275, 276
See application file for complete search history.

(56) References Cited

U.S. PATENT DOCUMENTS 4,144,720 A * 3/1979 Subera et al. ..... 62/256
4,439,992 A * 4/1984 Ibrahim ..... 62/82
4,535,603 A * 8/1985 Willitts et al. ..... 62/196.4
4,959,968 A * 10/1990 Fukuda ..... 62/155
5,694,782 A * 12/1997 Alsenz ..... 62/156
5,987,916 A 11/1999 Egbert
6,449,968 B1 9/2002 Singh et al.

FOREIGN PATENT DOCUMENTS

GB 2075165 A * 11/1981
JP 2001167341 A * 6/2001

* cited by examiner

*Primary Examiner*—Chen Wen Jiang
(74) *Attorney, Agent, or Firm*—Ogilvy Renault LLP

(57) ABSTRACT

A refrigeration system of the type having a compression stage, a condensation stage, an expansion stage and an evaporation stage, comprising a first evaporator group in the evaporation stage. The first evaporator group has two or more evaporators. A first valve is positioned upstream of the evaporators of the first evaporator group. The first valve is closeable to stop a supply of refrigerant to the evaporators of the first evaporator group simultaneously for a subsequent air defrost of the evaporators of the first evaporator group.

5 Claims, 4 Drawing Sheets

REFRIGERATION SYSTEM CONFIGURATION FOR AIR DEFROST AND METHOD

CROSS-REFERENCE TO RELATED APPLICATION

This patent application is a continuation-in-part of U.S. patent application Ser. No. 10/632,921, filed on Aug. 4, 2003 now abandoned.

TECHNICAL FIELD

The present invention generally relates to a refrigeration system for foodstuff refrigerators and, more particularly, to a refrigeration system configuration for evaporator defrost by convection, and a method pertaining to the refrigeration system configuration.

BACKGROUND ART

Frost forming on evaporators reduces the efficiency of the heat exchange between the evaporators and the air blown thereon. Refrigerators of all types must be kept at controlled temperatures to preserve the foodstuff in suitable conditions. Moreover, national regulations require that the refrigerators operate at predetermined conditions. Accordingly, it is known to provide various types of defrost systems/configurations for commercially used evaporators. The defrost systems therefore help to keep the evaporators in optimal operative conditions.

One type of defrost system involves the convective defrosting of the evaporators. In convective defrosting, hot air is blown onto the evaporator to melt the frost during a defrost period. The supply of refrigerant is stopped during the defrost period. In order to do so, a valve is provided upstream of the evaporator to cut the refrigerant supply.

Defrost systems of refrigeration systems of supermarkets or large food outlets are often fully automated. The valves that are upstream of the evaporators (e.g., solenoid) are all wired to a central controller that synchronizes the defrost period of the evaporators with the actuation of a heating coil that will warm up the air blown onto the evaporator in defrost mode.

Refrigeration systems with convective defrost systems presently have independent control for each evaporator. This allows the evaporators to each be defrosted individually, for instance while other evaporators are in a normal refrigerating mode. Although they offer the optimal control of the evaporators, these refrigeration systems represent an expensive solution in many ways, including equipment costs (valves at each evaporator, wiring), installation and programming expenses.

SUMMARY OF INVENTION

Therefore, it is a feature of the present invention to provide a novel defrost configuration for convective defrost of evaporators of a refrigeration system.

It is a further feature of the present invention to provide a defrost configuration for convective defrost of evaporators of a refrigeration system, which substantially overcomes the disadvantages of the prior art.

It is a further feature of the present invention to provide a method for stopping a supply of refrigerant a group of evaporators.

According to a feature of the present invention, from a broad aspect, there is provided a refrigeration system of the type having a compression stage, a condensation stage, an expansion stage and an evaporation stage, comprising a first evaporator group in the evaporation stage, the first evaporator group having at least two evaporators, and a first valve positioned on a line common to the at least two evaporators of the first evaporator group, the first valve being closeable to block a supply of refrigerant to the at least two evaporators of the first evaporator group simultaneously for a subsequent air defrost of the at least two evaporators of the first evaporator group.

Further in accordance with the present invention, there is provided a method for stopping a supply of refrigerant to evaporators of a refrigeration system of the type having a compression stage, a condensation stage, an expansion stage and an evaporation stage, for a subsequent air defrost of the evaporators, comprising the steps of providing a valve in a line common to the at least two evaporators of the evaporation stage, and closing the valve so as to block the supply of refrigerant to the at least two evaporators simultaneously.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
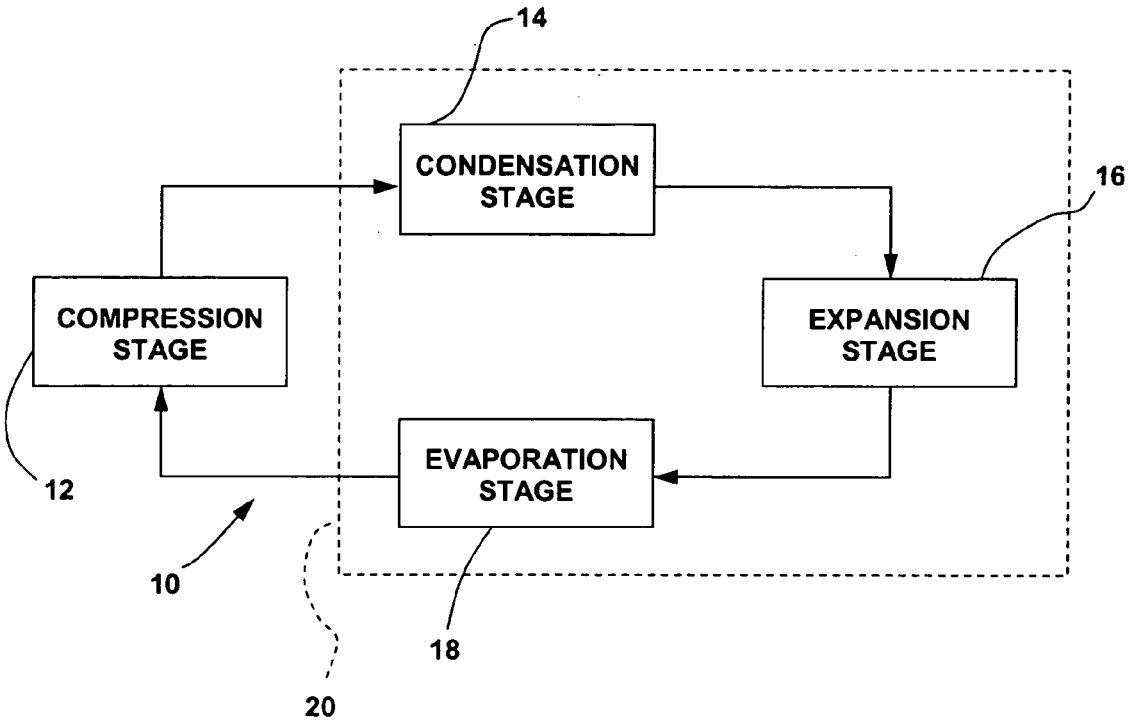
FIG. 1 is a block diagram illustrating a refrigeration system having a defrost configuration constructed in accordance with a preferred embodiment of the present invention.

Referring to the drawings and, more particularly to FIG. 1, a refrigeration system 10 consists of, sequentially, a compression stage 12, a condensation stage 14, an expansion stage 16 and an evaporation stage 18. The present invention is concerned with the defrost configuration between the condensation stage 14 and the evaporation stage 18. The stages 12, 14, 16 and 18 are interconnected for fluid connection therebetween, such that a refrigerant can be circulated therebetween.

In the condensation stage 14, high pressure gas refrigerant releases heat, and changes phase at least partially to liquid. In the expansion stage 16, high pressure liquid refrigerant is expanded to substantially decrease in pressure, to reach thereafter the evaporation stage 18 in a liquid state. In the evaporation stage 18, low-pressure refrigerant is circulated into evaporators to absorb heat from a fluid that comes into contact with the evaporators. The present invention relates to the interrelation between the condensation stage 14, the expansion stage 16 and the evaporation stage 18, as regrouped in circuit portion 20 in FIG. 1.

Figure 2:
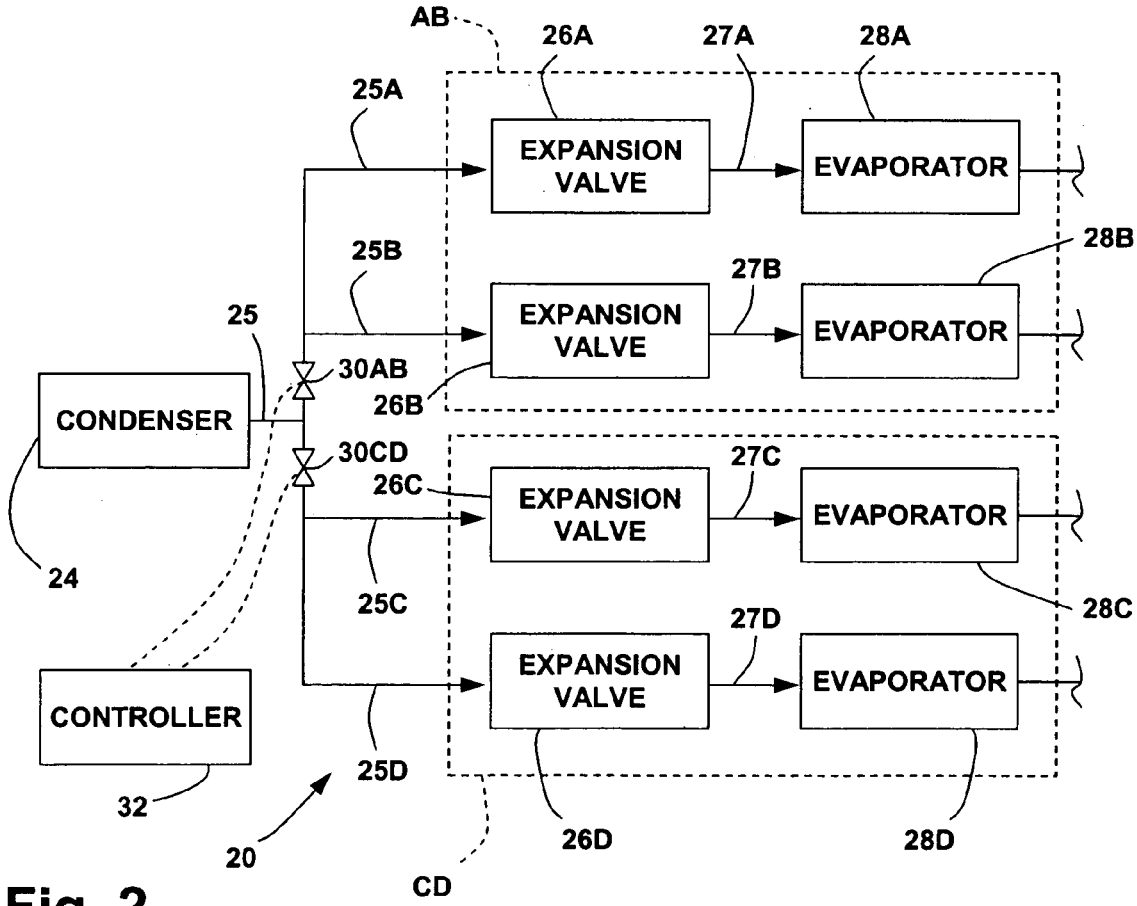
FIG. 2 is a block diagram of a defrost configuration of a first embodiment, between a condensation stage and an evaporation stage.

Referring concurrently to FIGS. 1 and 2, the circuit portion 20 is shown having a condenser 24 at the condensation stage 14. A refrigerant line 25 diverges from the condenser 24 to the expansion stage 16, into lines 25A to 25D. The circuit portion 20 has expansion valves 26A to 26D at the expansion stage 16, and each of the expansion valves is supplied by a respective one of the lines 25A to 25D. Each of the expansion valves 26A to 26D is associated with a respective evaporator 28A to 28D by refrigerant lines 27A to 27D. The evaporators 28A to 28D are represented by the evaporation stage 18 in FIG. 1.

Referring to FIG. 2, valve 30AB is positioned between the condenser 24 and the expansion valves 26A and 26B and, more precisely, between the refrigerant line 25 and the lines 25A and 25B. Similarly, valve 30CD is positioned between the condenser 24 and the expansion valves 26C and 26D and, more precisely, between the refrigerant line 25 and the lines 25C and 25D. Accordingly, the supply of refrigerant from the condenser 24 to the evaporators 28A and 28B can be stopped by the actuation of a single valve, namely the valve 30AB. Similarly, the supply of refrigerant from the condenser 24 to the evaporators 28C and 28D can be stopped by the actuation of the valve 30CD.

A controller 32 opens/closes the valves 30AB and 30CD to initiate the air defrost of the evaporators 28A to 28D. The controller 32 is also wired to blowers and heating coils (not shown) associated with each of the evaporators 28A to 28D, so as to synchronize the convective defrost of the evaporators 28A to 28D with the closing of the respective valves 30AB and 30CD.

Hence, the defrost operates by zones. Zone AB regroups evaporators 28A and 28B, whereas zone CD regroups evaporators 28C and 28D. Advantageously, one of the zones AB or CD is supplied with refrigerant in the normal refrigeration cycle, while the other zone undergoes defrost. The circuit portion 20 of FIG. 2 only has two zones for the simplicity of the present description. It is however contemplated to provide circuit portions having more than two zones. Valves 30AB and 30CD, as well as valves 60AB and 60CD described hereinafter, are for instance EPR, solenoid valves or the like.

Figure 3:
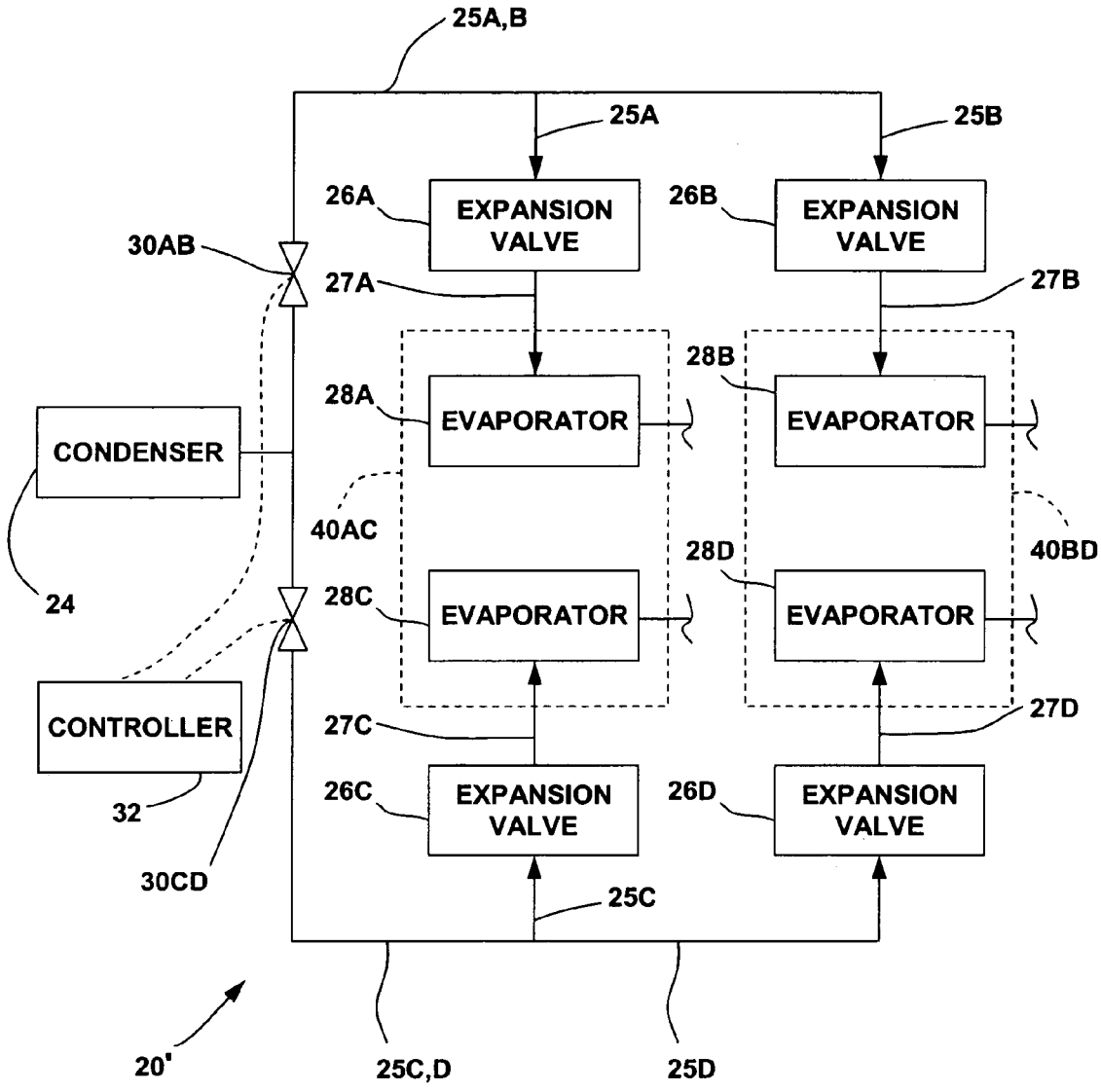
FIG. 3 is a block diagram of a defrost configuration constructed in accordance with a second embodiment of the present invention, between the condensation stage and the evaporation stage.

Referring concurrently to FIGS. 1 and 3, a second embodiment is generally shown as circuit portion 20'. Similarly to the circuit portion 20 of the refrigeration system 10 of FIG. 1, the circuit portion 20' includes a condensation stage 14, an expansion stage 16 and an evaporation stage 18. The circuit portion 20' has the condenser 24 at the condensation stage 14. The refrigerant line 25 diverges into the lines 25A to 25D to reach the respective expansion valves 26A to 26D. The expansion valves 26A to 26D are each respectively associated with one of the evaporators 28A to 28D by respective lines 27A to 27D. The evaporators 28A to 28D are represented by the evaporation stage 18 in FIG. 1.

Referring to FIG. 3, the valve 30AB is positioned between the condenser 24 and the expansion valves 26A and 26B, so as to control the supply of refrigerant in the lines 25A and 25B. Similarly, the valve 30CD is positioned between the condenser 24 and the expansion valves 26C and 26D, so as to control the supply of refrigerant in the lines 25C and 25D. Accordingly, the supply of refrigerant to the evaporators 28A and 28B can be stopped by closing the valve 30AB, for the convective defrost of the evaporators 28A and 28B. Similarly, the supply of refrigerant to the evaporators 28C and 28D can be stopped by closing the valve 30CD, for the convective defrost of the evaporators 28C and 28D. Similarly to the circuit portion 20 of FIG. 2, the circuit portion 20' has a controller 32 that controls the opening/closing of the valves 30AB and 30CD to initiate the air defrost of the evaporators 28A to 28D. The controller 32 is also wired to the blowers and heating coils (not shown) of the evaporators 28A to 28D, to synchronize the convective defrost of the evaporators 28A to 28D.

As seen in FIG. 3, the evaporator 28A and the evaporator 28C are part of a same refrigerated enclosure 40AC. Similarly, the evaporator 28B and the evaporator 28D are part of a refrigerated enclosure 40BD. Therefore, the closing of a single valve (e.g., the valve 30AB) will have two refrigerated enclosure (e.g., the refrigerated enclosures 40AC and 40BD) partially undergo convective defrost. As an example, the refrigerated enclosure 40AC can be kept at refrigerating temperatures by the evaporator 28C, while the other evaporator 28A is being defrosted. Thereafter, the defrost of evaporator 28C may be performed while the evaporator 28A operates in refrigeration.

Moreover, the evaporators regrouped in a zone (e.g., the evaporators 28A and 28B in the zone AB and the evaporators 28C and 28D in the zone CD) operate simultaneously in defrost and in refrigeration by the actuation of the valves 30AB or 30CD, thereby simplifying the control of the convective defrost of the circuit portion 20'.

Figure 4:
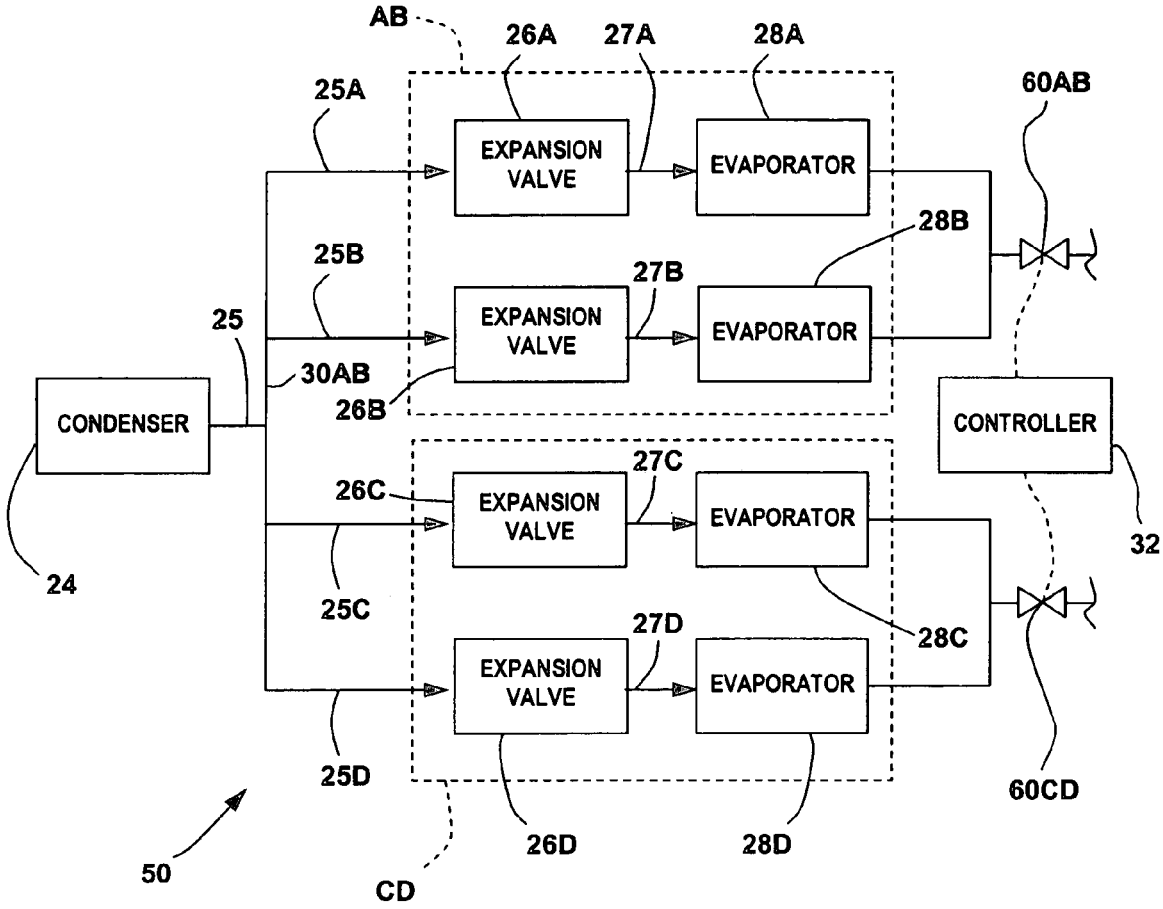
FIG. 4 is a block diagram of a defrost configuration in accordance with a third embodiment of the present invention.

Referring concurrently to FIGS. 1 and 4, a circuit portion in accordance with a third embodiment of the present invention is generally shown at 50. Similarly to the circuit portion 20 of the refrigeration system of FIG. 1, the circuit portion 50 includes a condensation stage 14, an expansion stage 16, and an evaporation stage 18. The circuit portion 50 has the condenser 24 at the condensation stage 14. A refrigerant line 25 diverges from the condenser 24 to the expansion stage 16, into lines 25A to 25D. The circuit portion 50 has expansion valves 26A to 26D at the expansion stage 16, and each of the expansion valves is supplied by a respective one of the lines 25A to 25D. Each of the expansion valves 26A to 26D is associated with a respective evaporator 28A to 28D by refrigerant lines 27A to 27D. The evaporators 28A to 28D are represented by the evaporation stage 18 in FIG. 1.

Referring to FIG. 4, valve 60AB is positioned between the evaporators 28A and 28B and the compression stage 12, the latter being downstream of the evaporators 28A and 28B. Similarly, valve 60CD is positioned between the evaporators 28C and 28D and the compression stage 12, the latter being downstream of the evaporators 28C and 28D. Accordingly, the supply of refrigerant from the condenser 24 to the evaporators 28A and 28B can be blocked by the actuation of a single valve, namely the valve 60AB. Similarly, the supply of refrigerant from the condenser 24 to the evaporators 28C and 28D can be blocked by the actuation of the valve 60CD.

A controller 32 opens/closes the valves 60AB and 60CD to initiate the air defrost of the evaporators 28A to 28D. The controller 32 is also wired to blowers and heating coils (not shown) associated with each of the evaporators 28A to 28D, so as to synchronize the convective defrost of the evaporators 28A to 28D with the closing of the respective valves 60AB and 60CD.

Hence, the defrost operates by zones. Zone AB regroups evaporators 28A and 28B, whereas zone CD regroups evaporators 28C and 28D. Advantageously, one of the zones AB or CD is supplied with refrigerant in the normal refrigeration cycle, while the other zone undergoes defrost. The circuit portion 20 of FIG. 2 only has two zones for the simplicity of the present description. It is however contemplated to provide circuit portions having more than two zones.

As opposed to the first and second embodiments, the circuit portion 50 of the third embodiment has its blocking valves downstream of the evaporators, rather than upstream of the expansion valves. Accordingly, if one of the valves 60AB or 60CD is closed in view of the air defrost of the evaporators with which it is associated, the refrigerant supply to the respective evaporators will not stop. More precisely, for example for zone AB, refrigerant will be supplied to the evaporators 28A and 28B, until the pressure thereat is above a maximum operating pressure of the expansion valves 26A and 26B, upstream of the evaporators 28A and 28B, respectively. As an example, the expansion valves 26A and 26B are Sporlan™ thermostatic expansion valves that close off once the evaporators go beyond a predetermined pressure value Beyond the maximum operating pressure of the expansion valves 26A and 26B, the refrigerant caught between the expansion valves 26A and 26B and the valve 60AB will release heat to the ice build-up/frost accumulated on the evaporators 28A and 28B. Accordingly, in addition to blowing of a hot airstream on the evaporators 28A and 28B, the refrigerant caught between the expansion valves 26A and 26B and the valve 60AB will participate in the defrost of the evaporators 28A and 28B. The zone CD operates in a similar fashion.

Figure 5:
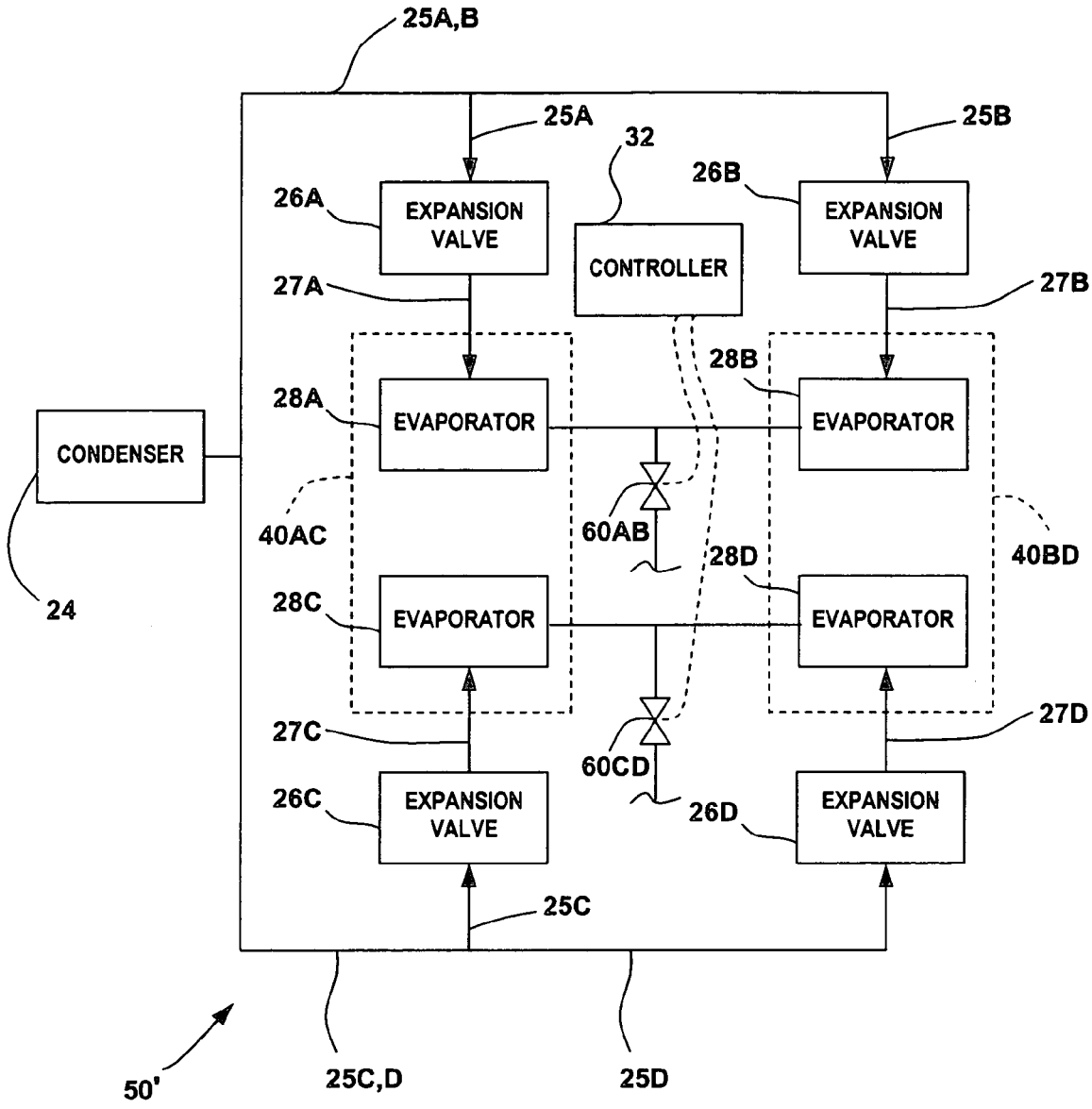
FIG. 5 is a block diagram of a defrost configuration constructed in accordance with a fourth embodiment of the present invention.

Referring concurrently to FIGS. 1 and 5, a fourth embodiment is generally shown as circuit portion 50'. Similarly to the circuit portion 50 of the refrigeration system 10 of FIG. 4, the circuit portion 50' includes a condensation stage 14, an expansion stage 16 and an evaporation stage 18. The circuit portion 50' has the condenser 24 at the condensation stage 14. The refrigerant line 25 diverges into the lines 25A to 25D to reach the respective expansion valves 26A to 26D. The expansion valves 26A to 26D are each respectively associated with one of the evaporators 28A to 28D by respective lines 27A to 27D. The evaporators 28A to 28D are represented by the evaporation stage 18 in FIG. 1.

Referring to FIG. 5, the valve 60AB is positioned between the evaporators 28A and 28B and the compression stage 12. Similarly, the valve 60CD is positioned between the condenser 24 and the expansion valves 26C and 26D, so as to control the supply of refrigerant in the lines 25C and 25D. Accordingly, the supply of refrigerant to the evaporators 28A and 28B can be blocked by closing the valve 60AB, for the convective defrost of the evaporators 28A and 28B. Similarly, the supply of refrigerant to the evaporators 28C and 28D can be blocked by closing the valve 60CD, for the convective defrost of the evaporators 28C and 28D. Similarly to the circuit portion 50 of FIG. 4, the circuit portion 50' has a controller 32 that controls the opening/closing of the valves 60AB and 60CD to initiate the air defrost of the evaporators 28A to 28D. The controller 32 is also wired to the blowers and heating coils (not shown) of the evaporators 28A to 28D, to synchronize the convective defrost of the evaporators 28A to 28D.

As seen in FIG. 5, the evaporator 28A and the evaporator 28C are part of a same refrigerated enclosure 40AC. Similarly, the evaporator 28B and the evaporator 28D are part of a refrigerated enclosure 40BD. Therefore, the closing of a single valve (e.g., the valve 60AB) will have two refrigerated enclosure (e.g., the refrigerated enclosures 40AC and 40BD) partially undergo convective defrost. As an example, the refrigerated enclosure 40AC can be kept at refrigerating temperatures by the evaporator 28C, while the other evaporator 28A is being defrosted. Thereafter, the defrost of evaporator 28C may be performed while the evaporator 28A operates in refrigeration.

Moreover, the evaporators regrouped in a zone (e.g., the evaporators 28A and 28B in the zone AB and the evaporators 28C and 28D in the zone CD) operate simultaneously in defrost and in refrigeration by the actuation of the valves 60AB or 60CD, thereby simplifying the control of the convective defrost of the circuit portion 20'.

The circuit portion 50' of FIG. 5 also benefits from the positioning the valves 60AB and 60CD downstream of the respective group of evaporators 28A, 28B and 28C, 28D. Accordingly, refrigerant accumulates between the expansion valves 26A and 26B and the valve 60AB in a first instance, and between the expansion valves 26C and 26D and the valve 60CD in another instance. Accordingly, the refrigerant accumulated therein will release heat to the frost on the evaporators 28A and 28B or 28C and 28D.

Preferably, the defrost control valves (e.g., 30AB and 30CD in FIGS. 2 and 3, and 60AB and 60CD in FIGS. 4 and 5) are provided in a refrigeration pack including the compressors of the compression stage 12 (FIG. 1), as well as various pumps, pipes (e.g., suction header), tanks and other valves. Accordingly, the wiring between the controller 32 and the defrost control valves is relatively short, as opposed to systems of the prior art in which wiring had to extend up to the evaporators to reach the individual control valves. Moreover, as there are fewer defrost control valves in accordance with the present invention as they are regrouped by zone and by portions of refrigerated enclosures, less wires are required.

It is within the ambit of the present invention to cover any obvious modifications of the embodiments described herein, provided such modifications fall within the scope of the appended claims.

The invention claimed is:

1. A refrigeration system of the type having a compression stage, a condensation stage, an expansion stage and an evaporation stage, comprising:

a first evaporator group in the evaporation stage, the first evaporator group having at least two evaporators, the at least two evaporators of the first evaporator group being in separated refrigerated enclosures;

a first valve positioned on a line common to the at least two evaporators of the first evaporator group, the first valve being closeable to block a supply of refrigerant to the at least two evaporators of the first evaporator group simultaneously for a subsequent air defrost of the at least two evaporators of the first evaporator group;

a second evaporator group in the evaporation stage, the second evaporator group having at least one evaporator, one evaporator of the first evaporator group and one evaporator of the second evaporator group being in a common refrigerated enclosure; and a second valve positioned on a line common to any evaporator of the second evaporator group, the second valve being closeable to block a supply of refrigerant to the at least one evaporator of the second evaporator group for a subsequent air defrost of the at least one evaporator of the second evaporator group;

whereby the first evaporator group and the second evaporator group are switchable to an air defrost mode independently from one another.

2. The refrigeration system according to claim 1, wherein the first valve is regrouped with the compression stage in a refrigeration pack.

3. The refrigeration system according to claim 1, further comprising a controller wired to the first valve so as to control the actuation of the first valve as a function of the air defrost.

4. The refrigerant system according to claim 1, wherein the first valve is positioned upstream of the at least two evaporators of the first evaporator group and between the condensation stage and the expansion stage.

5. The refrigeration system according to claim 1, wherein the first valve is positioned downstream of the at least two evaporators of the first evaporator group, whereby refrigerant accumulates between the expansion stage and the first valve to release heat to defrost build ups on the at least two evaporators.

* * * * *